United States Patent [19]

Garzon

[11] 4,434,336

[45] Feb. 28, 1984

[54] LIQUID $SF_6$ INTERRUPTER WITH ARC ENERGY DRIVEN PISTON AND CONTACT

[75] Inventor: Ruben D. Garzon, Malvern, Pa.

[73] Assignee: Brown Boveri Electric, Inc., Rolling Meadows, Ill.

[21] Appl. No.: 292,208

[22] Filed: Aug. 12, 1981

[51] Int. Cl.[3] ..... H01H 33/88

[52] U.S. Cl. ..... 200/150 G; 200/148 A

[58] Field of Search ..... 200/148 A, 150 G

[56] References Cited

U.S. PATENT DOCUMENTS 4,230,920 10/1980 Thaler ..... 200/150 G

FOREIGN PATENT DOCUMENTS 1221334 7/1966 Fed. Rep. of Germany ... 200/148 A

*Primary Examiner*—Robert S. Macon

*Attorney, Agent, or Firm*—Ostrolenk, Faber, Gerb & Soffen

[57] ABSTRACT

A liquid $SF_6$ circuit interrupter is disclosed which employs only one moving piston, eliminating the need for tie rods used in conventional liquid dielectric interrupters to connect two pistons in tandem, which tie rods were possible paths for flashovers. The moving contact is mounted at one end of a movable piston device in the other end of which is formed a bore that fits over a stationary piston secured to the housing. The interior of the bore communicates with the remainder of the interior of the housing via holes adjacent the moving contacts. When the movable piston device is moved to open the interrupter, the compression of fluid in the interior of the bore causes it to flow through the holes and through the arc region. The movable piston device also includes a piston member having one face exposed to the liquid dielectric in the housing and having an opposite face exposed to a lower ambient pressure. A net force tending to bias the interrupter into the open position results. This force is increased during interruption due to heat absorbed by the dielectric liquid from the arc. The pressure generated and the total travel of the movable contact depend on the amount of heat absorbed, and are proportional to the current being interrupted.

9 Claims, 2 Drawing Figures

LIQUID $SF_6$ INTERRUPTER WITH ARC ENERGY DRIVEN PISTON AND CONTACT

BACKGROUND OF THE INVENTION

The present invention pertains generally to circuit interrupters employing sulfur hexafluoride ($SF_6$) in the liquid phase as an arc quenching medium, and pertains particularly to such interrupters in which energy derived from the arc is used to provide at least part of the power for the opening stroke of the interrupter.

Power circuit interrupters using $SF_6$ as the interrupting medium have been continuously developed and improved over the last two decades. The basic concept of such interrupters is to create a pressure differential in the SF6 by means of a De Laval nozzle to establish the flow of gas from an upstream region to a downstream region along a path intersecting the electric arc that occurs between the contacts when the interrupter is opened. The arc is usually oriented generally parallel to the axis along which the moving contact moves during the opening stroke of the interrupter, and the nozzle is designed and positioned to cause the flow to be approximately axial to the arc.

It is generally desirable in such interrupters to make the pressure differential across the nozzle as great as possible during interruption. By doing so, two things are accomplished. First, the gas flow velocity increases until a sonic velocity is reached. Second, the rate of mass flow through the nozzle increases proportionally to the increase in pressure differential. It has been observed that these effects improve the interrupter's capability of recovering to higher rates of rise of recovery voltage and of interrupting larger fault currents.

The pressure differential across the nozzle has conventionally been obtained either by storing the $SF_6$ in the gaseous phase at a very high pressure and opening a blast valve to admit it into the arc region through the nozzle, or by the use of a piston coupled to a moving member, usually the moving contact. In the latter arrangement, known as a puffer type circuit breaker, as the moving contact is opened, the piston compresses the gas and forces it through the nozzle. With $SF_6$ in the gaseous phase, however, there are certain limitations on the maximum pressure differentials that can be obtained. If the gas is precompressed and stored at a high pressure, the low dew point of $SF_6$ presents a problem, as this substance will liquefy at a pressure of 275 psi at a temperature of approximately 20° C. The maximum operating pressure is thus limited to a figure below 300 psi if the $SF_6$ is to be maintained in the gaseous phase. In puffer type circuit breakers, on the other hand, the maximum obtainable pressure is limited primarily by the operating mechanism energy requirements, which increase rapidly as a function of the maximum pressure produced. In these circuit breakers, a considerable amount of power is required, since the work of compressing the gas must be performed in a short period of time.

To overcome these limitations encountered when using gaseous $SF_6$ at high pressure, interrupters have been developed in which $SF_6$ is used in the liquid phase. Two such arrangements are disclosed, respectively, in U.S. Pat. 4,268,733, issued to the present inventor on May 19, 1981, for A LIQUID SF6 PUFFER TYPE CIRCUIT INTERRUPTER (C-1812), and 4,278,860, issued in Jiing-Liang Wu on July 14, 1981, for an ARC DRIVEN SINGLE PRESSURE TYPE CIRCUIT BREAKER (C-1901). Both of these patents are assigned to the assignee of the present application. In each of the interrupters disclosed in these patents, two pistons that are connected to each other and held a spaced distance apart by insulative tie rods are used to force the liquid $SF_6$ through a nozzle the quench the arc. The insulative tie rods form an insulative path located electrically in parallel with the insulative tube used as a container for the liquid $SF_6$. The presence of two parallel insulating paths increases the risk of dielectric failures.

Another problem that has been encountered with previous liquid $SF_6$ interrupters is that if the interrupted current is relatively small, the energy absorbed by the $SF_6$ from the arc is too small to cause a sufficiently great increase in pressure, the $SF_6$ pressure to compensate fully for the increase in the volume occupied by the $SF_6$ (this volume increase is a result of the fact that the downstream piston is designed to present a larger effective area to the $SF_6$ than the upstream piston). The drop in pressure may be sufficient to lower the dielectric withstand capability of the $SF_6$ significantly. This problem can be overcome by designing a circuit breaker for small currents so that its piston assembly has only a short travel, but since a large travel is necessary to permit interruption of large currents, this expedient requires the production of several sizes of circuit breakers for use with currents of different magnitudes.

SUMMARY OF THE INVENTION

It is the principal object of the present invention to provide a circuit interrupter having the advantages of using liquid $SF_6$, while being free of the above disadvantages of previous designs.

It is another object of the invention to provide a liquid SF6 interrupter from which the need for tie rods is eliminated, decreasing the likelihood of flashovers.

It is still another object of the invention to provide an interrupter of simplified design, using only a single moving piston to propel the liquid SF6 through the arc region.

It is yet another object of the invention to provide an interrupter in which both the pressure used to drive the interrupter during its opening stroke and the total travel of the moving contact are proportional to the current being interrupted, so that one circuit breaker can be used to interrupt any current falling within a large range.

In its preferred embodiment, the present invention comprises an insulative housing containing SF6 under sufficient pressure to maintain it in the liquid phase. This pressure may for example be in the neighborhood of 1,000 psi. Portions of the housing near each end thereof are conductive to permit electrical connection of the contact assemblies of the interrupter to the line in which the interrupter is to be placed. A stationary contact assembly is disposed at one end of the housing, while a stationary cylindrical piston is disposed at the other end, facing the stationary contact assembly. A cylindrical movable piston assembly has a bore which fits over the stationary piston slidably and sealingly. The movable contact assembly is attached to the end of the movable piston assembly remote from the stationary piston, and holes are provided in the movable piston assembly to permit its bore to communicate with the remaining portion of the interior of the housing. The movable piston assembly further includes an annular piston member disposed at the end thereof remote from the contact assemblies. One face of the piston member is exposed to the pressure of the liquid $SF_6$ in the housing, while the other face is exposed to the ambient pressure, which must be less than that inside the housing. This arrangement results in a net force on the movable piston assembly urging it away from the stationary contact assembly. An operating mechanism is provided, including insulative rods attached to the outer face of the piston member of the movable piston assembly, to maintain the interrupter in the closed position. When it is desired to open the interrupter, the operating mechanism is released to allow the biasing force to drive the movable piston assembly away from the stationary contact assembly. The operating rods are preferably pulled during the opening stroke, rather than merely being released, to reduce the strain on them. During the opening stroke the movable piston assembly slides over the stationary piston, compressing the $SF_6$ contained in the bore of the former. This compression drives the $SF_6$ through the holes in the movable piston assembly, which are so placed as to cause the dielectric material to flow through the arc region between the movable and the stationary contact assemblies. A nozzle is provided on the movable contact assembly to increase the speed of the flow and to direct it more precisely through the arc region. A portion of the heat generated by the arc is absorbed by the $SF_6$, increasing the pressure thereof and thus increasing the net force driving the movable piston assembly toward the open position. As the arc is quenched, the rate of absorption of energy falls to zero, and the continuing net expansion of the volume containing the liquid $SF_6$ permits the pressure thereof to fall, gradually reducing the net force on the movable piston assembly. The smaller the current being interrupted, the sooner the net driving force falls, so that even if the interrupted current is relatively small, there is no danger of the pressure in the SF6 falling sufficiently low to decrease the dielectric capability of the interrupter to a dangerous point. When a large current is being interrupted, on the other hand, the great resulting rise in pressure drives the movable contact assembly to the open position much more quickly while simultaneously preventing a dangerous fall in pressure in the arc region. Only one movable piston is required, permitting the elimination of tie rods and the danger of flashover across them.

Other objects and features of the invention will be apparent from the following description and the accompanying drawings.

DETAILED DESCRIPTION OF THE PREFERRED EMBODIMENT

Figure 1:
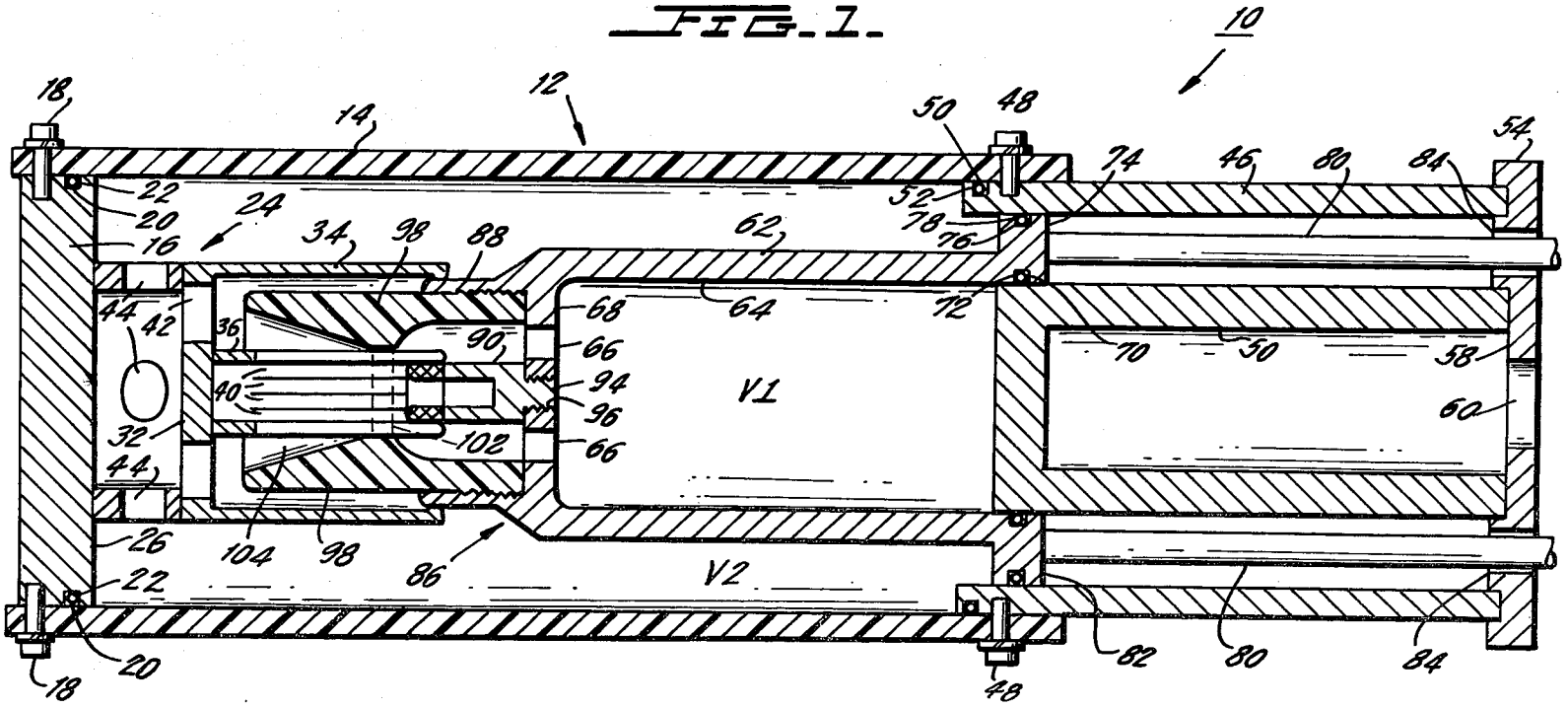
FIG. 1 is a cross-sectional view of the preferred embodiment of the interrupter of the invention, showing it in the closed position.
Figure 2:
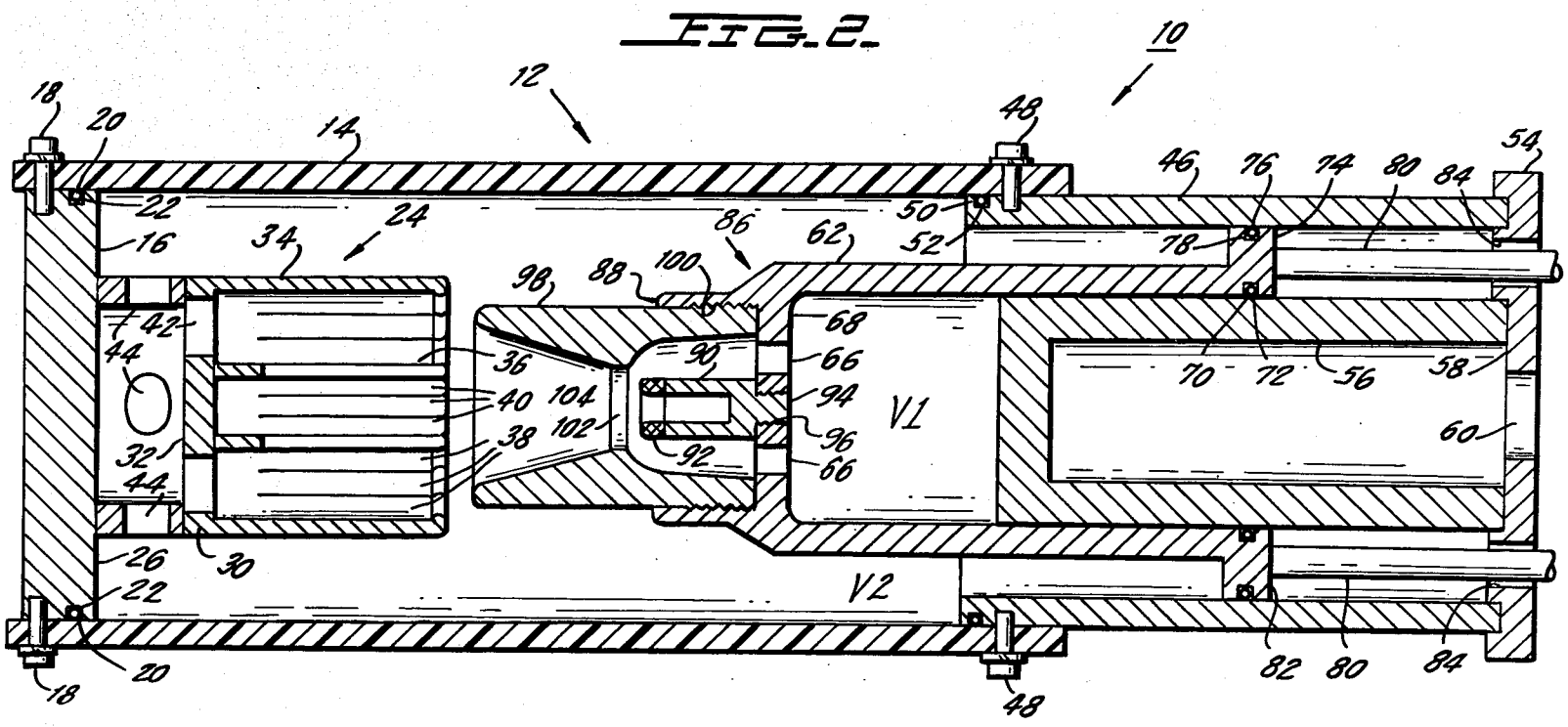
FIG. 2 is a view similar to that of FIG. 1, showing the interrupter in a position with the movable contact moved part way to the open position.

FIG. 1 shows a circuit interrupter 10 according to the preferred embodiment of the present invention in the closed position, while FIG. 2 shows the same interrupter 10 in a partially open position. In the embodiment shown, the interrupter 10 has a housing 12, the major part of which comprises an insulative tube 14. A conductive end plate 16 is received in one end of the tube 14 and secured thereto by means of bolts 18. A seal 20 is provided between the inner surface of the insulative tube 14 and end plate 16, the seal 20 being received in a groove 22 formed in the periphery of the end plate 16. The stationary contact assembly 24 is secured to the inner face 26 of the end plate 16. In the preferred embodiment shown, the stationary contact assembly 24 comprises a cylindrical mounting piece 28 having one end secured directly to the end plate 16 and having its other end secured to a cylindrical cup-shaped contact structure 30. Structure 30 comprises a base plate 32 secured to the end of the mounting piece 28. The main stationary contact 34 comprises a plurality of contact fingers arranged around the periphery of the base plate 32, with which they are continuous and integral. An inner stationary contact or arcing contact 36 comprises a second plurality of fingers arranged within the concentric with the main stationary contact 34. The fingers of the inner stationary contact are secured to the central portion of the base plate 32. The slits 38 and 40, which divide the main stationary contact 34 and the stationary arcing contact 36 respectively into pluralities of resilient contact fingers, preferably extend only a portion of the way from the free end of the contacts 34, 36 to the base plate 32. A plurality of holes 42 are provided in the base plate 32 to permit the interior of the stationary contact to communicate with the interior of mounting piece 28. Additional holes 44 are provided in the latter to permit its interior to communicate with the remainder of the interior of the housing 12.

In the other end of the insulative tube 14 is received a conductive tube 46, which is secured to the insulative tube 14 by means of bolts 48. The junction between tubes 14 and 46 is sealed by means of a sealing ring 50 received in a groove 52 formed in the outer periphery of the conductive tube 46. The conductive tube 46 serves for the electrical connection of the moving contact assembly to the line in which the interrupter 10 is used. A second conductive end plate 54 is secured to the end of tube 46 remote from insulative tube 14.

A stationary piston 56 is secured to the inner face 58 of the end plate 54. The stationary piston 56 has the form of a hollow cylinder closed at the inner end, i.e. the end remote from end plate 54. A hole 60 is preferably provided in the end plate 54 to permit the pressure in the interior of the stationary piston 56 to remain equal to the ambient pressure, although this feature is not essential. The stationary piston 56 extends along the axis of housing 12 a distance slightly less than the length of the conductive tube 46. A movable piston assembly 62 is provided with an internal cylindrical bore 64 of the same diameter as the outer diameter of stationary piston 56. The movable piston assembly 62 fits slidably over the stationary piston 56. When the interrupter is in the closed position, the interior of the bore 64 forms a volume V1, which communicates with the remaining portion V2 of the interior of housing 12 via a plurality of small holes 66 provided in the end wall 68 of the movable piston assembly 62. As the interrupter moves toward the open position, as indicated in FIG. 2, the movable piston assembly 62 slides along the length of the stationary piston 56, reducing the size of volume V1, as shown in FIG. 2. When the interrupter 10 reaches the completely open position, the movable piston assembly 62 fits snugly over the stationary piston 56, and the volume V1 is reduced to zero. A seal 70 is provided between the mating surfaces of bore 64 and stationary piston 56, the seal 70 being provided in a groove 72 in the inner surface of bore 64 at the end thereof relatively remote from the contact assemblies.

At the open end of the movable piston assembly 62 (the right-hand end in the Figures) is a piston member 74 that is an integral part of the movable piston assembly 62 and is received in the annular space between the stationary piston 56 and the inner bore of the conductive tube 46. The piston member 74 has the form of an annular flange, the outer peripheral surface of which is provided with a groove 76 in which is provided a sealing ring 78 to seal the interface between piston member 74 and conductive tube 46. A plurality of operating rods 80 made of an insulative material are secured to the outer face 82 (the right-hand face in the Figures) of piston member 74 and extend through holes 84 provided for them in end plate 54. The operating rods 80 are connected to a conventional operating mechanism or control mechanism (now shown) for controlling the opening and closing of the interrupter 10.

The volumes V1 and V2, which together comprise what is herein referred to as the interior of the interrupter 10, are filled with a dielectric material in the liquid phase, preferably sulfur hexafluoride. When $SF_6$ is used, the pressure in the interior of the interrupter 10 may be for example in the neighborhood of 1,000 psi. The portion of the space between stationary piston 56 and tubular member 46 and between the outer face 82 of piston member 74 and the inner face 58 (left-hand face in the Figures) of the end plate 54 is not filled with the liquid dielectric, but communicates via holes 84 with the exterior of the interrupter 10, which is ordinarily in air at atmospheric presssure or in gaseous SF6 at a relatively low pressure.

The moving contact assembly 86 is provided on the end of the moving piston assembly 62 nearer the stationary contact assembly 24. The moving contact assembly 86 comprises an outer or main moving contact 88 and concentric therewith an inner or arcing moving contact 90. The main moving contact 88 is a cylindrical sleeve continuous and integral with the moving piston assembly 62, from which it extends axially toward the stationary contact assembly 24. The inner moving contact 90 is a hollow cylindrical member having its free end 92 made of a special arc resistant material, and having a central threaded portion 94 extending axially from its other end and received threadably in a threaded bore 96 formed in the end wall 68 of the movable piston assembly 62. A generally cylindrical structure 98 is threadably received by threads 100 formed in the inner surface of the main moving contact 88. Structure 98 is shaped to define a constriction 102 in the path from holes 66 to the arc region 104 (see FIG. 2).

When the interrupter 10 is in the closed position, the main moving contact 88 serves as a male contact received in the cylinder defined by the fingers of the main stationary contact 34, while the inner moving contact 90 is similarly received in the interior of the inner stationary contact 36. The four contacts 34, 36, 88 and 90 are so dimensioned that when the interrupter 10 is opened, the outer contacts 34 and 88 will disengage before the inner contacts 36 and 90 do so, so that the electric arc will occur in the radially inward region 104 between the inner contacts 36 and 90 (see FIG. 2). With the interrupter 10 in the closed position, the nozzle structure 98 extends into the annular space between the inner and outer stationary contacts 36 and 34.

The interrupter 10 of the invention may be used in air, or may be enclosed in a grounded housing filled with gaseous $SF_6$ at a relatively low pressure.

The operation of the interrupter 10 of the invention will now be described.

To interrupt a current, the operating mechanism (not shown) is actuated to draw the movable piston assembly 62 and the movable contact assembly 86 away from the stationary contact assembly 24 (to the right in the Figures) by means of operating rods 80. As the contacts disengage, an arc occurs between stationary arcing contact 36 and movable arcing contact 90 in the region 104 indicated in FIG. 2. The rightward motion of the movable piston assembly 62 reduces the size of volume V1, increasing the pressure of the essentially incompressible liquid SF6 contained therein. At the same time, the size of volume V2 is increasing due to the rightward motion of the piston member 74, decreasing the pressure of the liquid contained therein. The resulting pressure differential between volumes V1 and V2 causes a flow of liquid $SF_6$ from volume V1 through holes 66. The nozzle 98 directs the flow of the liquid through the arc region 104 and into the interior of the stationary contact structure 24. This flow though the arc region 104 deionizes the arc, eventually quenching it. The fluid continues to flow though holes 42 into the interior of mounting piece 28 and then through holes 44 into the main portion of the interior of the interrupter 10.

The moving piston assembly 62 and moving contact assembly 86, as noted above, are moved to the right by means of an operating mechanism acting on operating rods 80. The majority of the power used to open the interrupter 10, however, is derived not from the operating mechanism but from the arc itself. The high temperature of the arc causes a transfer of heat to the surrounding $SF_6$. The resulting increase in the enthalpy of the $SF_6$ increases the pressure therein. It will be clear from the foregoing description and from the Figures that the leftward pressure on the movable piston assembly 62 exerted by the fluid contained in volume V1 is less than the rightward force exerted thereon by the liquid in volume V2, assuming that the pressure in V1 is not too much greater than that in volume V2. The net rightward force is due to the presence of piston member 74 and to the fact that the inner diameter of bore 64 is less than the outer diameter of the moving piston assembly 62. A net rightward force is obtained even if the pressure in volume V1 is somewhat greater than that in volume V2, because of the difference in the total effective areas of moving piston assembly 62 that are acted on by the pressures in V2 and in V1.

As energy from the arc is absorbed by the surrounding $SF_6$, the magnitude of the net rightward force is proportionally increased, driving the movable piston assembly 62 and the movable contact assembly 86 to the right with constantly increasing force. The rightward motion further reduces the size of volume V1, and as the speed of the movable contact assembly 86 increases, the pressure differential between the liquid in volume V1 and that in the constriction 102 defined between nozzle 78 and inner movable contacts 90 increases, proportionally increasing both the rate at which the mass of the liquid in volume V1 is caused to pass through nozzle 78 and the arc region 104, and the speed with which it flows, increasing the quenching action of the dielectric medium. Since the magnitude of the current being interrupted determines the rate at which energy is absorbed by the $SF_6$ from the arc, it will be clear from the foregoing description that the speed of the opening stroke increases proportionally with the size of the interrupted current. In addition, the total distance the movable contact assembly 86 actually travels before the arc is quenched varies proportionally with the value of the current being interrupted.

In this manner, the arc energy is utilized not only to drive the opening stroke of the interrupter 10, but to obtain a contact gap proportional to the pressure increase of the $SF_6$ and consequently proportional to the fault current being interrupted. When a small current is interrupted, the gap attained by the end of the quenching process is relatively small, ensuring that the pressure of the $SF_6$ in the arc region never falls low enough to degrade the dielectric capability of the liquid. When a very large current is interrupted, on the other hand, a relatively large gap is quickly achieved, improving the interrupting capability of the device.

The present invention may be embodied in other specific forms without departing from the spirit or essential attributes thereof, and accordingly, reference should be made to the appended claims, rather than to the foregoing specification, as indicating the scope of the invention.

What is claimed is:

1. A circuit interrupter, comprising:

a housing containing a substantially incompressible dielectric material in the liquid phase at a pressure higher than the pressure immediately surrounding said housing;

stationary contact means in said housing;

movable contact means in said housing and movable therein between an engaged position, in which it engages said stationary contact means, and a disengaged position, in which it is physically spaced from and electrically isolated from said stationary contact means;

stationary piston means in said housing;

movable piston means secured to aid movable contact means and having a bore in which said stationary piston means is slidably received; the interior of said bore communicating with a region between said stationary and and said movable contact means to cause fluid flow into said region when said movable contact means is displaced from its said engaged position; said movable piston means having a piston member which has a first face exposed to said pressure of said dielectric material in the interior of said housing and having a second face exposed to said lower pressure immediately surrounding said housing;

sliding seal means disposed between said movable piston means and said stationary piston means for preventing flow of fluid between the volumes which include said first and second faces during contact interruption; and control means for maintaining said movable contact means in said engaged position to maintain a current therethrough, and for releasing said movable contact means to allow it to move from said position engaged toward said disengaged position for interrupting a current flowing through said interrupter.

2. The interrupter of claim 1, wherein said movable piston means has first and second ends, said bore being formed in said first end and said movable contact means being disposed at said second end.

3. The interrupter of claim 2, wherein said piston member is disposed at said first end.

4. The interrupter of claim 3, wherein said stationary piston means is generally cylindrical, and said piston member is generally annular.

5. The interrupter of claim 2, wherein said movable piston means has holes defined in said second end thereof for allowing the interior of said bore to communicate with the remaining portion of the interior of said housing.

6. The interrupter of claim 5, wherein said movable piston means comprises an insulative member disposed at said second end thereof for defining a nozzle, said nozzle being located for causing a flow of said dielectric material from the interior of said bore, through said holes and through said arcing region when said movable contact means moves from its said engaged position toward its said disengaged position.

7. The interrupter of claim 1, in which each said contact means comprises an outer main contact and an inner arcing contact.

8. The interrupter of claim 1, wherein said control means includes operating rods secured to said second face of said piston member.

9. The interrupter of claim 1, wherein said dielectric material is sulfur hexafluoride.

* * * * *